US006830294B2

(12) United States Patent
Berthiaume

(10) Patent No.: US 6,830,294 B2
(45) Date of Patent: Dec. 14, 2004

(54) FOLDABLE SEATING STRUCTURE

(76) Inventor: Gilles Berthiaume, 260, Chemin Magenta, Farnham, Quebec (CA), J2N 2R2

( * ) Notice: Subject to any disclaimer, the term of this patent is extended or adjusted under 35 U.S.C. 154(b) by 0 days.

(21) Appl. No.: 10/420,769

(22) Filed: Apr. 23, 2003

(65) Prior Publication Data

US 2003/0230916 A1 Dec. 18, 2003

(30) Foreign Application Priority Data

Apr. 23, 2002 (GB) ..... 0209209

(51) Int. Cl.[7] ..... A47C 15/00

(52) U.S. Cl. ..... 297/232; 297/158.4; 297/235; 297/158.3; 297/158.2; 297/248; 297/249; 108/168; 108/169

(58) Field of Search ..... 297/248, 257, 297/249, 157.1, 158.2, 158.3, 158.4, 159.1, 129; 108/168, 169, 167, 173, 171

(56) References Cited

U.S. PATENT DOCUMENTS 2,777,742 A * 1/1957 Schieber ..... 108/169
3,075,809 A * 1/1963 Wilson ..... 297/158.4
3,099,481 A * 7/1963 Bue ..... 297/158.4
3,511,532 A * 5/1970 Tringali et al. ..... 297/158.4
3,715,143 A * 2/1973 Gerken et al. ..... 297/158.4
6,014,936 A * 1/2000 Rogers et al. ..... 108/167
6,053,576 A * 4/2000 Jessee ..... 297/344.19
6,223,661 B1 * 5/2001 Griepentrog ..... 108/169
6,254,178 B1 * 7/2001 Bue ..... 297/159.1
6,644,221 B2 * 11/2003 Griepentrog ..... 108/169

* cited by examiner

*Primary Examiner*—Peter M. Cuomo
*Assistant Examiner*—Erika Garrett

(57) ABSTRACT

A foldable seating structure includes a foldable frame defining a first frame section and a second frame section. The first and second frame sections are coupled together by a section hinge allowing the first and second frame sections to pivot relative to one another between a frame deployed configuration and a frame folded configuration wherein in the frame deployed configuration the first and second frame sections are in a substantially horizontal position and in a substantially co-linear relationship relative to each other and wherein in the frame folded configuration the first and second frame sections are in a substantially vertical position and in a substantially parallel and adjacent relationship relative to each other.

4 Claims, 7 Drawing Sheets

10
12
14
16
18
20
22
24
26
28
30
32
34
38
40
42
46
50
54
56
57
58
60
62
68
70
72
74
88

70
54
30
54
70
72
76
50
52
78
74
72
50
74
34
50
56
58
32
50
56
58

22

66
34
40
58
76
76
58
40
38
26
24
38
32
70
54
52
20
34
30
54
74
74

70
32

FOLDABLE SEATING STRUCTURE

FIELD OF THE INVENTION

The present invention relates to the general field of seating structures and is particularly concerned with a foldable seating structure.

BACKGROUND OF THE INVENTION

There exists a plurality of situations wherein it is desirable to install temporary seating arrangements. For example, it may be desirable to temporary increase the number of seats available in a conventional waiting room, a conventional entertainment theatre, a church or any other location wherein multiple seats arranged in a row configuration are typically provided.

It may also be desirable to temporary install seats in areas wherein the seats need to be readily removed after their use in order to allow the location to be used for other purposes then that of seating spectators. For example, it may be desirable to temporarily set up seats in a gymnasium, an arena, a multifunctional room or other suitable locations.

Whether the seats are required in a room deprived of existing seating arrangements or in a room needing increased seating structures, it is often desirable that the seats be readily and easily installable through a set of quick and ergonomical steps. It is also desirable to allow the seats to be easily and readily removed also through easy and ergonomical steps.

In most situations, it is desirable to arrange the seats in rows that are independently moveable relative to each other. Typically, the rows are arranged in substantially parallel relationship relative to each other allowing intended users to be seated while providing passage between the rows. This type of seating arrangement is typically used in situations wherein the intended users face in a common direction such as when attending a political convention, a trade show, an entertainment or sports related performance or any other type of situations. Other times, it is desirable to have the rows arranged in other configurations such as surrounding a stage. Yet, in other situations, it is desirable to allow the rows of seats to remain free to move independently relative to each other in order to provide for various types of configurations depending on the outcome of the activity.

A common method of providing rows of seats is to individually place seats in a side-by-side relationship relative to each other. Evidently, this method is both tedious and time consuming. The effort required is compounded in situations wherein the rows of seat need to be readily moved from one position to another.

Another solution involves the use of frame-like units. A common disadvantage of such systems is that they typically require a large number of separate components. Also, typically, their assembly is somewhat difficult. Furthermore, the seats typically provided with frame-like units are often of a plank-type which not only adds to the number of separate components required, but are uncomfortable to sit on for long periods. Still further, these units are typically heavy, unwieldy, bulky to stow and difficult to handle and erect. Accordingly, there exists a need for an improved seating arrangement.

SUMMARY OF THE INVENTION

It is a general object of the present invention to provide a foldable row seating arrangement adapted to mitigate the foregoing disadvantages.

In accordance with the present invention, there is provided a foldable seating structure for allowing a first and a second user to sit thereon, the seating structure comprising: a foldable frame, the foldable frame defining a first frame section and a second frame section, the first and second frame sections respectively defining a first and a second frame axis, the first and second frame sections being coupled together by a section hinge, the section hinge allowing the first and second frame sections to pivot relative to one another in a section pivoting plane about a section pivoting axis between a frame deployed configuration and a frame folded configuration wherein in the frame deployed configuration the first and second frame axes are in a substantially horizontal position and in a substantially co-linear relationship relative to each other and wherein in the frame folded configuration the first and second frames axes are in a substantially vertical position and in a substantially parallel and adjacent relationship relative to each other; a first and a second seat respectively mounted on the first and second frame sections so as to extend respectively in a substantially parallel relationship relative to respectively the first and second frame axis; whereby when the foldable frame is in the frame deployed configuration, the first and second seats are in a substantially horizontal position allowing the first and second users to seat in a side by side relationship relative to each other and, when the foldable frame is in the folded configuration, the first and second seat are in a substantially vertical and adjacent relationship relative to each other so as to minimize the required storage space.

Typically, the foldable seating structure further comprises a deployed configuration releasable locking means for releasably locking the first and second frame sections in the deployed configuration. Conveniently, the foldable seating structure further comprises a folded configuration releasable locking means for releasably locking the first and second frame sections in the frame folded configuration.

Typically, the foldable seating structure further comprises—a deployed configuration releasable locking means for releasably locking the first and second frame sections in the deployed configuration; and a folded configuration releasable locking means for releasably locking the first and second frame sections in the frame folded configuration.

Conveniently, the foldable seating structure further comprises a pair of wheels rotatably mounted to the foldable frame adjacent the first and second frame distal ends. Typically, the wheels are positioned so as to stably support the foldable frame thereon when the foldable frame is in the folded configuration.

Conveniently, the section hinge is configured and sized for releasably locking the foldable frame in the deployed configuration. Typically, the first and second frame sections respectively include corresponding first and second seat attachment members, the first and second seat attachment members respectively defining a corresponding first and second section proximal end and a corresponding first and second section distal end; the first and second frame sections being also respectively provided with a first and a second proximal leg pivotally attached respectively to the first and second seat attachment members respectively adjacent the first and second section proximal ends; the first and second frame sections being also respectively provided with a first and a second distal leg pivotally attached respectively to the first and second seat attachment members respectively adjacent the first and second section distal ends.

Typically, the foldable seating structure further comprises a first and a second proximal-to-distal leg linking member respectively pivotally attached between the first and second proximal and distal legs for ensuring that the first and second proximal legs pivot solidarly respectively with the first and second distal legs. Conveniently, the foldable seating structure further comprises a first and a second proximal leg-to-opposed section linking member respectively pivotally attached to the first and second proximal legs and to an opposite frame section for ensuring that the movement of the first and second proximal legs are transmitted respectively to the second and first frame sections.

Typically, the first and second proximal leg-to-opposed section linking members are attached respectively to the second and first frame sections respectively proximally to the second and first section proximal ends. Conveniently, the section hinge, the first and second proximal legs, the first and second distal legs, the first and second proximal-to-distal leg linking members and the first and second proximal leg-to-opposed section linking members are configured and sized so as to allow the section hinge to act as an eccentric-type means for selectively facilitating and restraining the relative movement of the first and second frame sections between the frame deployed and folded configurations.

Typically, the section hinge, the first and second proximal legs, distal legs, proximal-to-distal leg linking members and proximal leg-to-opposed section linking members are configured and sized so as to allow the section hinge to act as an eccentric-type for selectively facilitating and restraining the relative movement of the frame sections from the deployed to the folded configurations.

Conveniently, the section hinge includes a first and a second hinge member, the first and second hinge members being respectively fixedly attached to the first and second frame members; the first and a second hinge members being also pivotally attached together for relative pivotal movement therebetween about a hinge pivot axis; the first and second hinge members being configured, positioned and sized so as to form respectively a substantially "V"-shaped configuration and a substantially inverted "V"-shaped configuration when the foldable frame is respectively in the deployed configuration and in the folded configuration.

Typically, the first and a second proximal leg-to-opposed section linking members cross by each other about a crossing location, the pivot hinge being located respectively underneath and above the level of the crossing location when the foldable frame is respectively in the deployed configuration and in the folded configuration.

Typically, the foldable seating structure further comprises a first and a second leg biasing means respectively extending between the first and second frame sections and respectively the first and second distal legs for biasing the first and second distal legs respectively away from the first and second frame sections.

Typically, the foldable seating structure further comprises a first and a second leg biasing means respectively extending between the first and second frame sections and respectively the first and second distal legs for biasing the first and second distal legs respectively away from the first and second frame sections.

Conveniently, each of the first and second distal legs defines a distal leg attachment segment pivotally attached respectively to the first and second frame members and a distal leg supporting segment extending from the distal leg attachment segment for contacting the ground surface; the distal leg attachment segment defining an attachment segment sustentation polygon larger then that of the distal leg attachment segment.

In accordance with the present invention, there is also provided a foldable seating structure for allowing a first and a second user to sit thereon, the seating structure comprising: a foldable frame, the foldable frame defining a first frame section and a second frame section, the first section defining a first section proximal end and a first section distal end, the second frame section defining a second section proximal end and a second section distal end; the first and second frame sections being coupled together respectively adjacent the first and second section proximal ends by a section hinge, the section hinge allowing the first and second frame sections to pivot relative to one another in a section pivoting plane about a section pivoting axis between a frame deployed configuration and a frame folded configuration wherein in the frame deployed configuration the first and second frame sections are in a substantially horizontal position and in a substantially collinear relationship relative to each other with the first and second frame distal ends spaced from each other by the first and second section proximal ends and wherein in the frame folded configuration the first and second frame sections are in a substantially vertical position and in a substantially parallel relationship relative to each other with the first and second frame proximal ends and the first and second frame distal ends respectively in substantially adjacent relationships relative to each other; a first and a second seat respectively mounted on the first and second frame sections so as to extend respectively in a substantially parallel relationship relative to respectively the first and second frame sections; whereby when the frame is in the frame deployed configuration, the first and second seats are in a substantially horizontal position allowing the first and second users to seat in a side by side relationship relative to each other and, when the frame is in the folded configuration, the first and second seat are in a substantially vertical and adjacent relationship relative to each other so as to minimize the required storage space.

In accordance with the present invention, there is further provided a foldable seating structure for supporting a first and a second seat, the first and second seat allowing a first and a second user to sit thereon, the seating structure comprising: a foldable frame, the foldable frame defining a first frame section and a second frame section, the first and second frame sections respectively defining a first and a second frame axis, the first and second frame sections being coupled together by a section hinge, the section hinge allowing the first and second frame sections to pivot relative to one another in a section pivoting plane about a section pivoting axis between a frame deployed configuration and a frame folded configuration wherein in the frame deployed configuration the first and second frame axes are in a substantially horizontal position and in a substantially co-linear relationship relative to each other and wherein in the frame folded configuration the first and second frames axes are in a substantially vertical position and in a substantially parallel and adjacent relationship relative to each other; the first and second seats being respectively mounted on the first and second frame sections so as to extend respectively in a substantially parallel relationship relative to respectively the first and second frame axis; whereby when the foldable frame is in the frame deployed configuration, the first and second seats are in a substantially horizontal position allowing the first and second users to seat in a side by side relationship relative to each other and, when the foldable frame is in the folded configuration, the first and second seat are in a substantially vertical and adjacent relationship relative to each other so as to minimize the required storage space.

Advantages of the present invention include that the proposed seating arrangement is designed so as to be movable between a deployed configuration allowing intended users to sit in a side-by-side relationship relative to each other and a folded or compact configuration facilitating transportation and storage of the seating structure.

The foldable seating structure is designed so as to facilitate movement of the seating structure between its folded and deployed configurations through a set of quick and ergonomical steps without requiring special tooling, manual dexterity or a substantial amount of force.

The proposed seating structure is provided with a built-in mechanism for ensuring that the seating arrangement remains in its deployed configuration until a substantial predetermined amount of force or movement is imparted thereon. Also, the proposed seating structure is provided with a built-in mechanism for selectively assisting the folding thereof against the action of gravity.

Furthermore, the proposed foldable row seating arrangement is specifically designed so as to be relatively stable in both the deployed and folded configurations so as to provide a sturdy support for its intended users and for individuals manipulating the arrangement.

Still furthermore, the proposed seating arrangement allows for the use of multiple types of seats including individual chairs having a seat and a back portion, ganged chairs, benches or the like.

Also, the proposed seating structure is designed so as to be manufacturable through conventional forms of manufacturing using conventional components so as to provide a seating structure that will be economically feasible, long-lasting and relatively trouble-free in operation.

BRIEF DESCRIPTION OF THE DRAWINGS

An embodiment of the present invention will now be disclosed, by way of example, in reference to the following drawings in which.

DETAILED DESCRIPTION

Figures 1, 2:
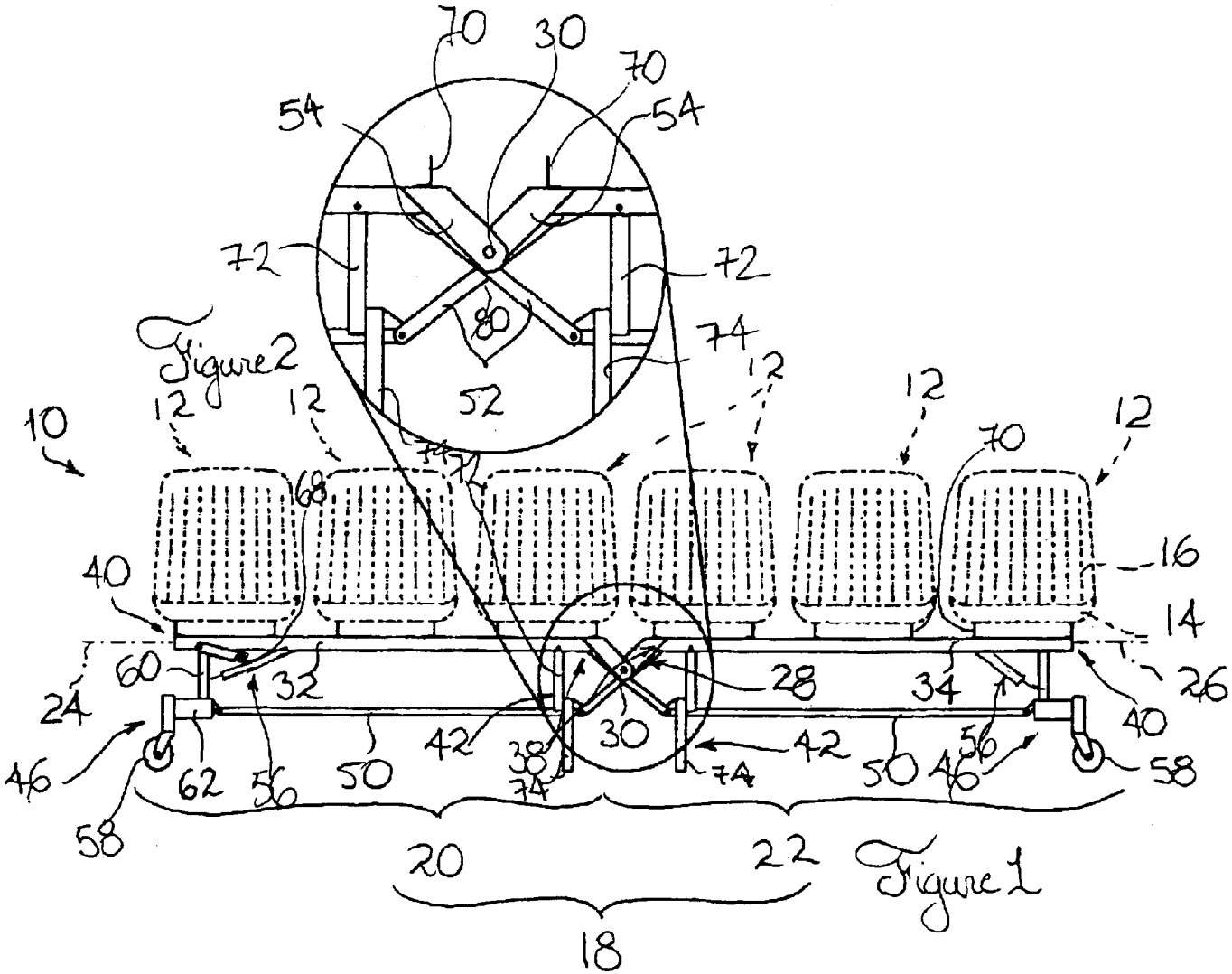
FIG. 1, in a front elevational view illustrates a foldable seating structure in accordance with an embodiment of the present invention, the foldable seating structure being shown in a deployed configuration.
FIG. 2, in a detailed view taken inside arrows 2—2 of FIG. 1, illustrates a linking and hinged assembly part of the foldable seating structure shown in FIG. 1 when the latter is in a deployed configuration.
Figures 3, 4:
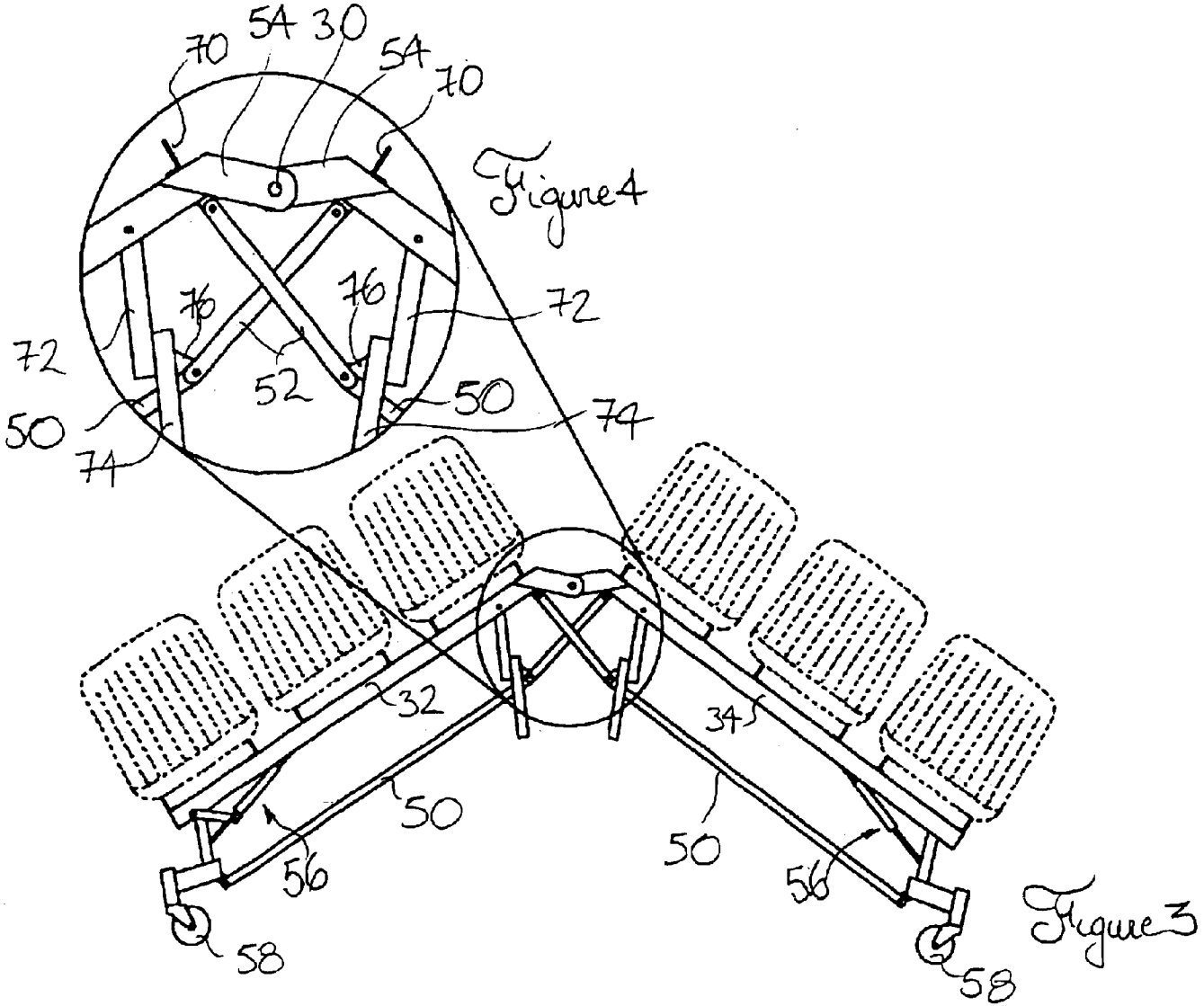
FIG. 3, in a front elevational view, illustrates the foldable seating structure shown in FIG. 1 about to be folded in a partially deployed configuration.
FIG. 4, in a detailed view taken inside arrows 4—4 of FIG. 3, illustrates the configuration of the linkage and hinge assembly shown in FIG. 2 when in a partly deployed configuration.
Figures 5, 6:
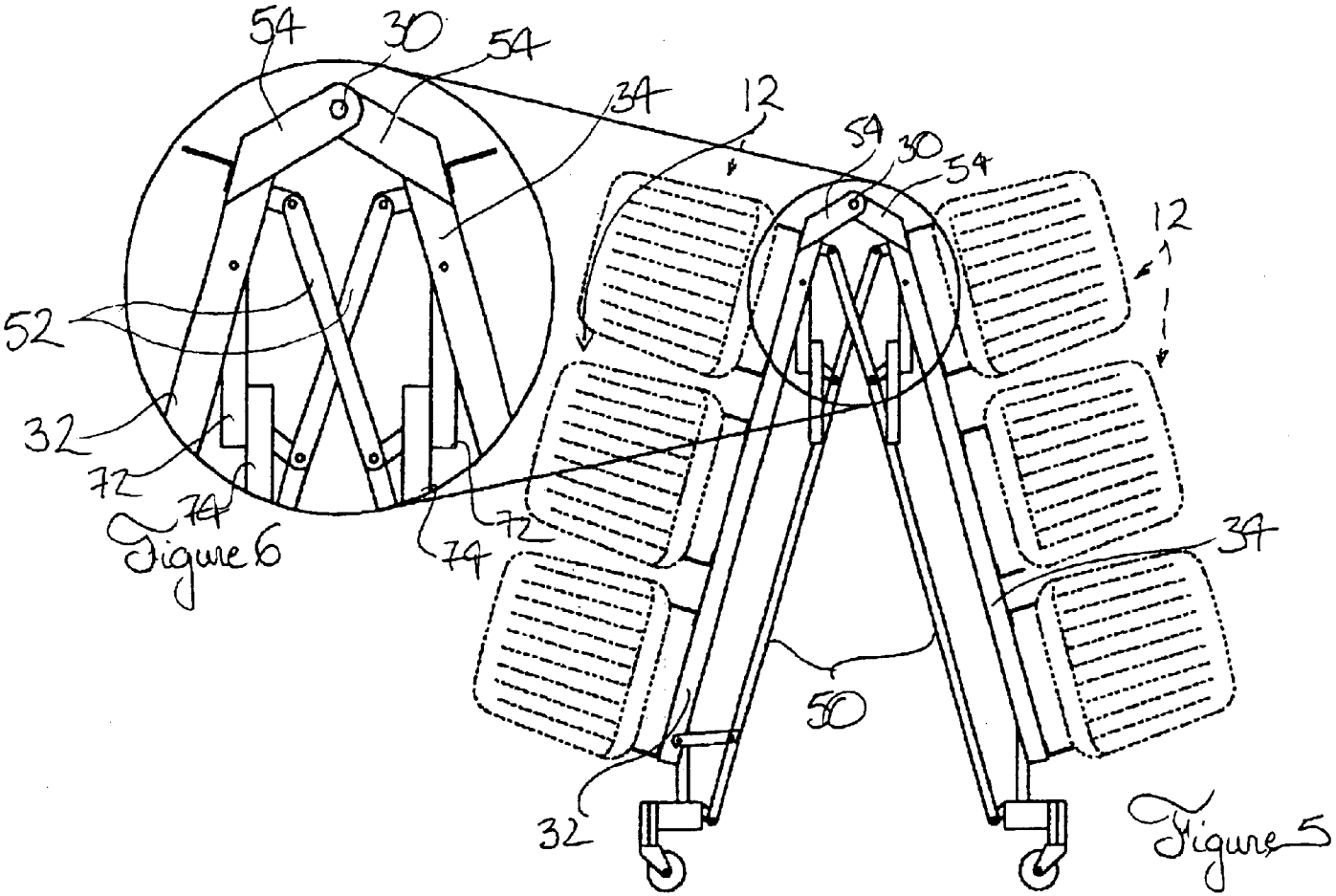
FIG. 5, in a front elevational view, illustrates the foldable seating structure shown in FIGS. 1 through 4 about to be folded in a partially folded configuration.
FIG. 6, in a detailed view taken in side arrows 6—6 of FIG. 5, illustrates the configuration of the linkage and hinge assembly shown in FIGS. 2 and 4 when the latter is in a partially folded configuration.

Referring to FIG. 1, there is shown a foldable seating structure 10 in accordance with an embodiment of the present invention. The foldable seating structure 10 is shown in a fully deployed configuration. The foldable seating structure 10 is shown throughout the figures as including chair-type seating components 12. The chair-type seating components 12 are shown as including a seat section 14 for receiving the buttocks and part of the thigh region of an intended user and a back rest section 16 extending from the seat section 14 for supporting at least part of the back region of an intended user.

It should, however, be understood that the seating components 12 could have other configurations such as a bench-type configuration or any other suitable configuration without departing from the scope of the present invention. Also, throughout the figures, the foldable seating structure 10 is shown as including six seating components 12. It should be understood that the foldable seating structure 10 could include any suitable number of seating components 12 without departing from the scope of the present invention.

The seating structure 10 includes a foldable frame 18 including a first frame section 20 and a second frame section 22. It should be understood that although the first frame section 20 is shown as being on the left hand side of the foldable frame 18 while the second frame section 22 is shown as being on the right hand side of the foldable frame 18 when seen in a front elevational view, the first and second frame sections 20, 22 could be positioned on either side of the foldable frame 18 without departing from the scope of the present invention. It should also be understood that the present invention also relates to a foldable frame 18 for supporting seating components 12 and, hence, that the present invention relates both to a foldable seating structure 10 including the foldable frame 18 and the seating components 12 and to the foldable frame 18 per se.

The first and second frame sections 20, 22 respectively define a first and a second frame axis 24, 26. The first and second frame sections 20, 22 are coupled together by a section hinge 28. The section hinge 28 allows the first and second frame sections 20, 22 to pivot relative to one another in a section pivoting plane about a section pivoting axis 30 between a frame deployed configuration shown in FIG. 1 and a frame folded configuration shown in FIG. 7.

Figures 7, 8:
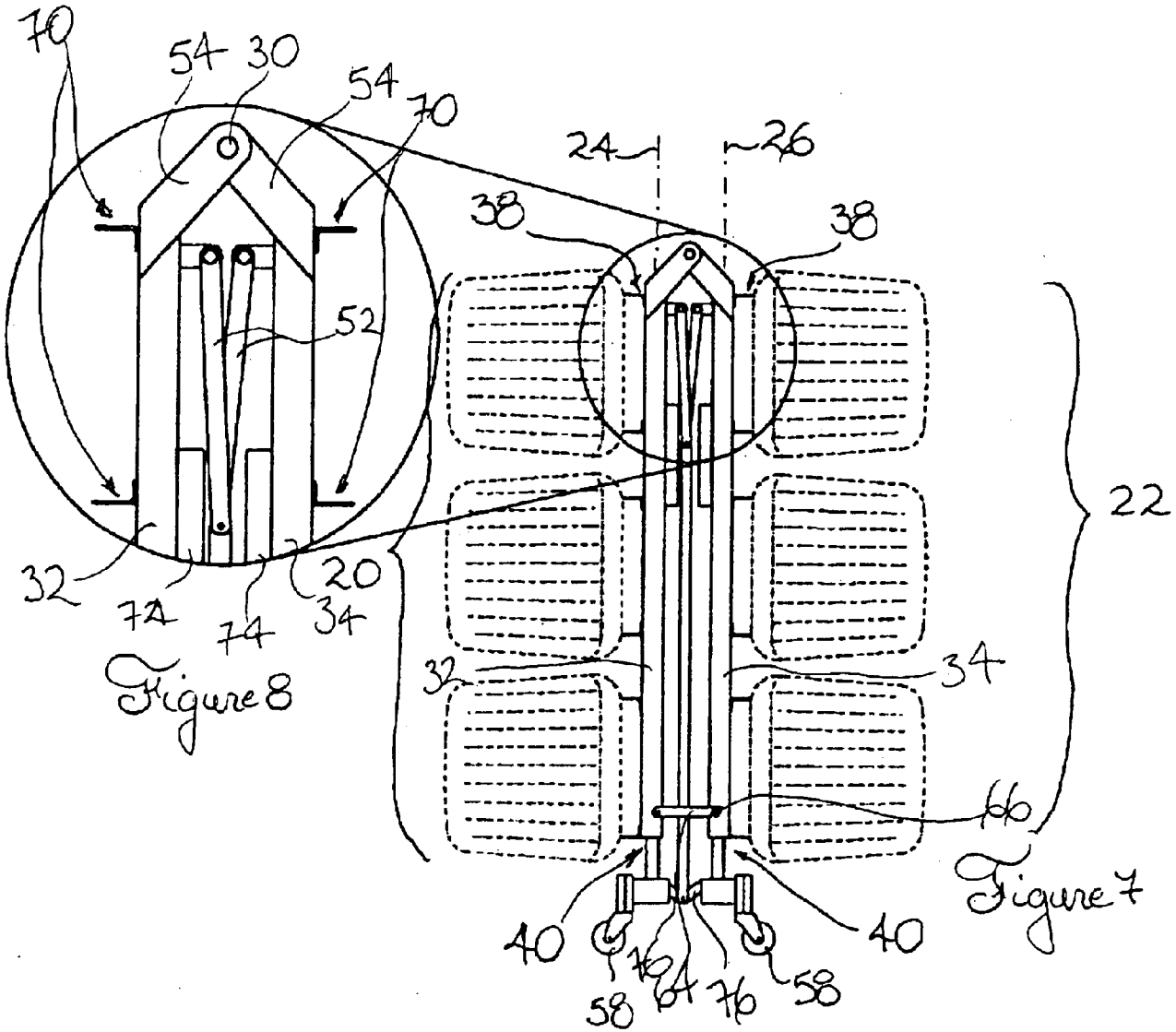
FIG. 7, in a front elevational view, illustrates the foldable seating structure shown in FIGS. 1 through 6, when foldable seating structure is in a folded configuration.
FIG. 8, in a detailed view taken inside arrows 8—8 of FIG. 7, illustrates the configuration of the linkage and hinge assembly shown in FIGS. 2, 4, and 6 when the latter is in a folded configuration.

In the frame deployed configuration shown in FIG. 1, the first and second frame axes 24, 26 are in a substantially horizontal position and in a substantially co-linear relationship relative to each other. As illustrated in FIG. 7, in the frame folded configuration, the first and second frame axes 24, 26 are in a substantially vertical position and in a substantially parallel and adjacent relationship relative to each other.

At least one, and typically three first seat components 12 and at least one and typically two second seat components 12 are respectively mounted on the first and second frame sections 20, 22 so that the seating section 14 thereof extends in a parallel relationship relative to respectively the first and second frame axis 24, 26. Hence, when the foldable frame 18 is in the frame deployed configuration, the seating section 14 of the first and second seating components 12 are in a substantially horizontal position allowing intended users to sit thereon in a side-by-side relationship relative to each other. Also, when the foldable frame 18 is in the folded configuration, the seating section 14 of the first and second seating components 12 are in a substantially vertical and adjacent relationship relative to each other so as to minimize the required storage space for storing the foldable seating structure 10.

The first and second frame sections 20, 22 typically respectively include corresponding first and second elongated seat attachment members 32, 34. As shown more specifically in FIGS. 11 and 12, the first and second frame sections 20, 22 typically respectively include a pair of substantially parallel first seat attachment members 32 and a pair of substantially parallel second seat attachment members 34.

It should however be understood that any suitable number of first and second seat attachment members 32, 34 could be used without departing from the scope of the present invention. When more than one first and second seat attachment member 32, 34 is used, the groups of first and second seat attachment members 32, 34 are maintained in a predetermined spaced and typically parallel relationship relative to each other by attachment member spacing links 36 extending typically in a substantially perpendicular relationship relative thereto.

The first and second seat attachment members 32, 34 respectively define a corresponding first and second section proximal end 38 and a corresponding first and second section distal end 40. As shown respectively in FIGS. 1 and 7, when the foldable frame 18 is respectively in its deployed and folded configuration, the first and second section distal ends 40 are typically respectively in a spaced apart and in a proximal relationship relative to each other.

The first and second frame sections 20 22 are also respectively provided with a first and a second proximal leg 42 pivotally attached respectively to the first and second seat attachment members 32, 34 respectively adjacent the first and second section proximal ends 38. As shown more specifically in FIGS. 11 and 12, the first and second frame sections 20, 22 are typically provided with a pair of first and second proximal legs 42. When more than one first and second section proximal leg 42 is used, the first and second proximal legs 42 are typically maintained in a predetermined spaced-apart relationship relative to each other by proximal leg spacing links 44 extending substantially perpendicularly therebetween.

The first and second frame sections 20, 22 are further respectively provided with a first and second distal leg 46 pivotally attached respectively to the first and second seat attachment members 32, 34 respectively adjacent the first and second distal ends 40. As shown more specifically in FIGS. 11 and 12, the first and second frame sections 20, 22 are typically provided with a pair of first and second distal legs 42 maintained in a predetermined spaced-apart relationship relative to each other with corresponding distal leg spacing links 48.

The seating structure 10 is typically further provided with a first and a second proximal-to-distal leg linking member 50 respectively pivotally attached between the first and second proximal and distal legs 42, 46 for ensuring that the first and second proximal legs 42 pivot solidarity respectively with the first and second distal legs 46. As shown more specifically in FIGS. 11 and 12, when a pair of proximal and distal legs 42, 46 is used, the proximal-to-distal leg linking members 50 are typically pivotally attached to the proximal leg spacing link 44 and to the distal leg spacing link 48.

The seating structure 10 typically still further includes a first and a second proximal leg-to-opposed section linking member 52 respectively pivotally attached to the first and second proximal legs 42 and to an opposite frame section 22, 20 for ensuring that the movement of the first and second proximal legs 42 are transmitted respectively to the second and first frame sections 22, 20. As shown more specifically in FIGS. 11 and 12, when a pair of first and second proximal legs 42 is used, the proximal leg-to-opposed section linking members 52 are typically attached to the corresponding proximal leg spacing links 44. Also, typically, the first and second proximal leg-to-opposed section linking members 52 are typically attached respectively to the second and first frame sections 22, 20 respectively proximally to the second and first section proximal ends 38.

Typically, the section hinge 28, the first and second proximal legs 42, the first and second distal legs 46, the first and second proximal-to-distal leg linking members 50 and the first and second proximal leg-to-opposed section linking members 52 are configured and sized so as to allow the section hinge 28 to act as an eccentric-type locking means for selectively facilitating and restraining the relative movement of the first and second frame sections 20, 22 between the frame deployed and folded configuration.

Typically, the section hinge 28 includes at least one and preferably two first hinge members 54 and at least one and preferably two second hinge members 54.

The first and second hinge members 54 are respectively fixedly attached to the first and second frame members 20, 22. The first and second hinge members 54 are also pivotally attached together for relative pivotal movement therebetween about the hinge pivot axis 30. As shown more specifically in FIGS. 1 and 7, the first and second hinge members 54 are configured, positioned and sized so as to form together respectively a substantially V-shaped configuration and a substantially inverted V-shaped configuration when the folding frame 18 is respectively in the deployed and in the folded configuration.

The seating structure 10 typically still further includes a first and second leg biasing means 56 extending between the first and second frame sections 20, 22 and respectively the first and second distal legs 46 for biasing the first and second distal legs 46 pivotally away respectively from the first and second frame sections 20, 22. Typically, although by no means exclusively, the first and second leg biasing means 56 includes a piston-type spring component. Preferably, the piston-type component is a pneumatic piston having a minimal damping effect.

Figure 11:
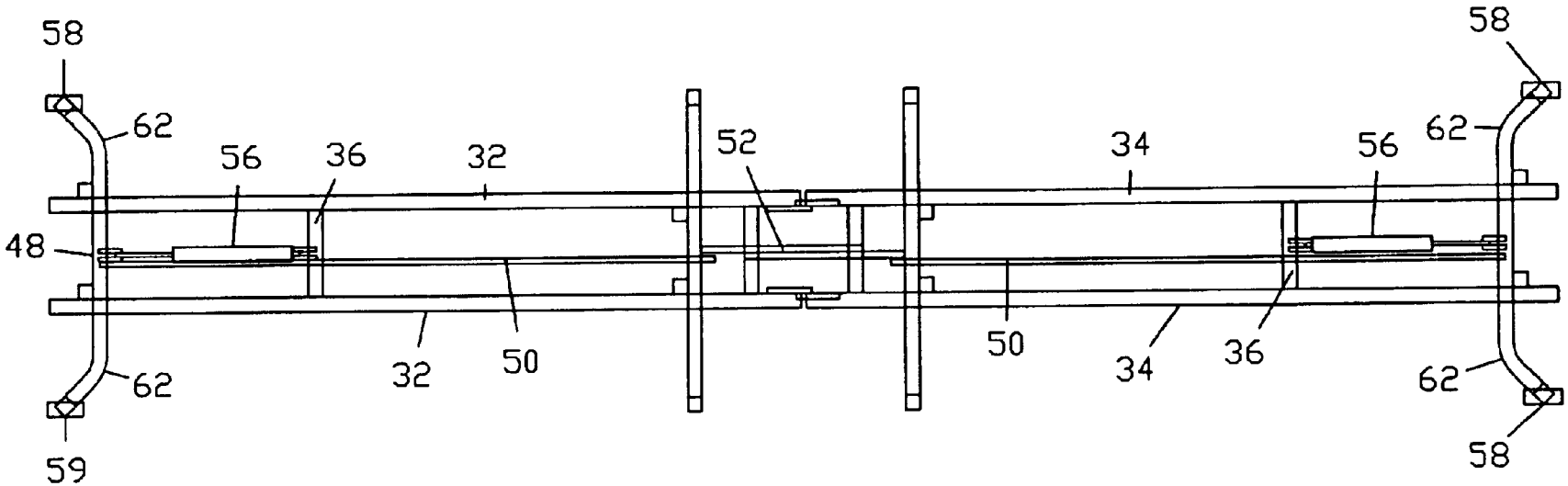
FIG. 11, in a top view, illustrates part of the foldable seating structure shown in FIGS. 1 through 10, the foldable seating structure being shown with seat components removed therefrom.
Figure 12:
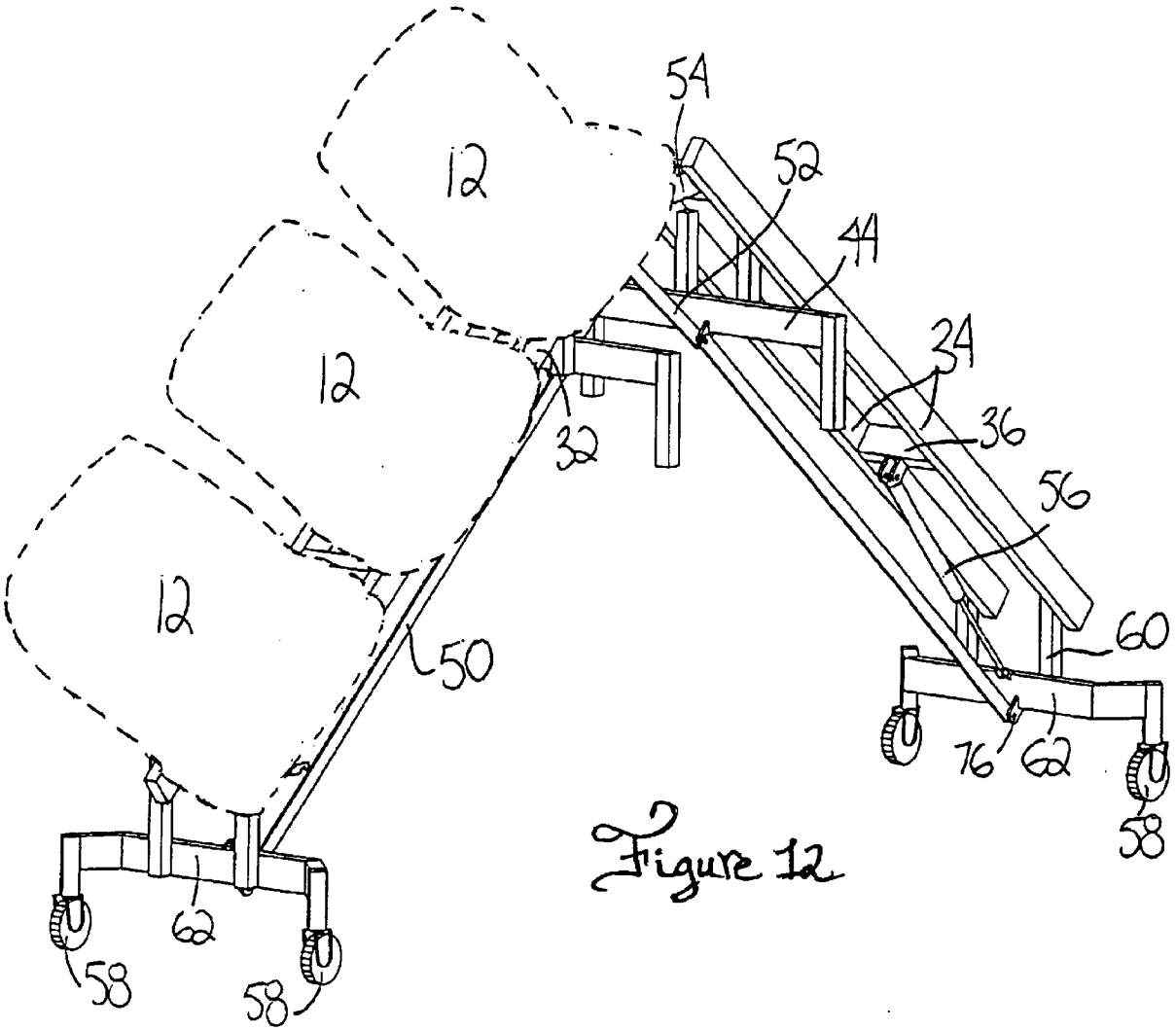
FIG. 12, in a perspective view, illustrates the foldable seating structure shown in FIGS. 1 through 11 in a partially deployed configuration with seats components removed therefrom.

As shown more specifically in FIGS. 11 and 12, when a pair of first and second distal legs 46 are used, the first and second leg biasing means typically extends between the distal leg spacing links 48 and the corresponding first and second frame section 20, 22. Typically, when a pneumatic or hydraulic piston-type component 56, the piston-type component 56 is attached to the first and second framed sections 20, 22 and to the corresponding first and second distal leg spacing links 48 so as to extend substantially at 45 degrees relative to the latter when the foldable frame 18 is in its deployed configuration shown in FIG. 1 and so as to extend in a generally parallel relationship relative to the first and second seat attachment members 32, 34 when the foldable frame 18 is in its folded configuration shown in FIG. 7.

The foldable seating structure 10 typically also includes roller or caster-type wheels 58 rotatably mounted to the first and second distal legs 46. As shown more specifically in FIGS. 11 and 12, the first and second distal legs 46 typically include a distal leg attachment segment 60 pivotally attached respectively to the first and second frame members 20, 22 and a distal leg supporting segment 62 extending from the distal attachment segment 60 for supporting the wheels 58 contacting the ground surface.

Typically, the distal leg supporting segment 62 defines a supporting segment sustentation polygon larger than that of the distal leg attachment segment 60. Typically, the distal leg supporting segment 62 extends outwardly relative to the corresponding distal leg attachment segment 60 both in a direction parallel and in a direction perpendicular to the first and second segment axes 24, 26. Typically, when seen from a top view, the distal leg supporting segment 62 has a substantially "U"-shaped configuration with the side legs of the "U" shape diverging away from each other in a direction leading away from the base of the "U" shape.

The caster-type wheels 58 are typically rotatably attached to the distal leg supporting segments 62 and are intended to facilitate transportation of the seating structure 10, in particular when the seating structure 10 is in its folded configuration shown in FIG. 7. The distal leg supporting segments 62 are configured and sized so that the centre of mass of the seating structure 10 projected vertically onto the ground surface is located within the sustentation polygon formed by the distal leg supporting segments 62 and the caster-type wheels 58 rotatably attached thereto. Hence, the configuration and size of the distal leg supporting segments 62 is intended to reduce the risks of having the seating structure 10 tilt when in the folded configuration shown in FIG. 7.

The seating structure 10 is optionally further provided with a folded configuration releasable locking means for releasably locking the first and second frame sections 20, 22 in the frame folded configuration. In the embodiment of the invention shown throughout the figures, the folded configuration releasable locking means includes a locking arm 64 pivotally attached to at least one of the first seat attachment members 32 and a corresponding locking pin 66 extending from a corresponding at least one of the second seat attachment members 34. The locking arm 64 is provided with a pin receiving groove 68 formed therein for releasably receiving and securing thereinto the locking pin 66 when in the configuration shown in FIG. 7.

The seating structure 10 is still further typically provided with seat receiving components mounted on the first and second seat attachment members 32, 34 for receiving and securing thereto the seating section 14 of the seating components 12. When seating components 12 such as shown throughout the figures are used, each seat receiving component typically includes a pair of generally L-shaped brackets 70 having a leg thereof secured either to the first or to the second seat attachment members 32, 34. It should be understood that other types of seat receiving components could be used depending on the type of seating components 12 being used without departing from the scope of the present invention.

As shown throughout the figures, the first and second proximal legs 42 typically include a proximal leg attachment segment 72 pivotally attached respectively to the first and second seat attachment members 32, 34 and a proximal leg supporting segment 74 extending from a corresponding proximal leg attachment segment 72 for contacting the ground surface. The proximal leg supporting segments 74 are typically offset relative to the corresponding proximal leg attachment 72 so as to allow the proximal attachment segments 72 to fold inwardly adjacent the corresponding first and second seat attachment members 32, 34 and the proximal leg supporting segments 74 to fold over the corresponding first and second seat attachment members 32, 34 when the foldable frame 18 is in its folded configuration such as shown in FIG. 7.

Also, as is well known in the art, in order to facilitate folding of the foldable frame 18 to its folded configuration shown in FIG. 7, some of the pivotal links between pivotable components may include spacing members 76 also commonly referred to as "pad-eyes". The pivotal links themselves may include pivotal pins, bolts, rivets or any other suitable components. Furthermore, the caster-type wheels 58 may optionally be provided with wheel locking and/or shock absorbing means for respectively, selectively and releasably locking the caster-type wheels 58 against rotation and/or providing shock absorption to the seating structure 10 so as to reduce the risk of tilting during transportation thereof.

In use, the seating structure 10 is intended to be moved between its deployed and storage configurations through a set of quick and ergonomical steps. When in the deployed configuration shown in FIG. 1, the configuration of the section hinge 28 and of the first and second proximal leg-to-opposed section linking members 52 is intended to provide a self-locking eccentric-type releasable locking means for maintaining the foldable structure 18 in its deployed configuration.

The first and second proximal-to-opposed section linking members 52 typically cross by each other about a crossing location 80. When the foldable frame 18 is in its deployed configuration, as shown more specifically in FIGS. 2 and 9, the pivot axis 30 is located substantially in register or slightly below the crossing location 80. The force exerted by the biasing means 56 puts the first and second proximal-to-distal leg linking members 50 under tension.

Figure 9:
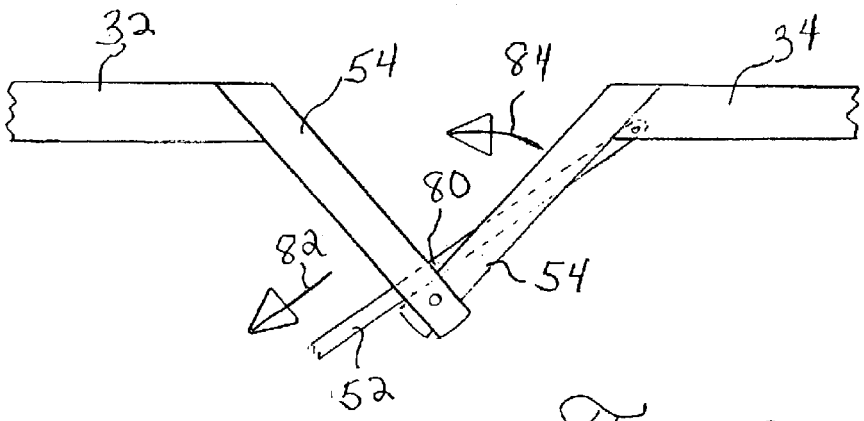
FIG. 9, in a partial front view with sections taken out, illustrates the configuration of some of the components of the linkage and hinge assembly shown in FIGS. 2, 4, 6, and 8 when the linkage and hinge assembly acts as an eccentric type releasable locking means for maintaining the foldable seating structure in a deployed configuration.
Figure 10:
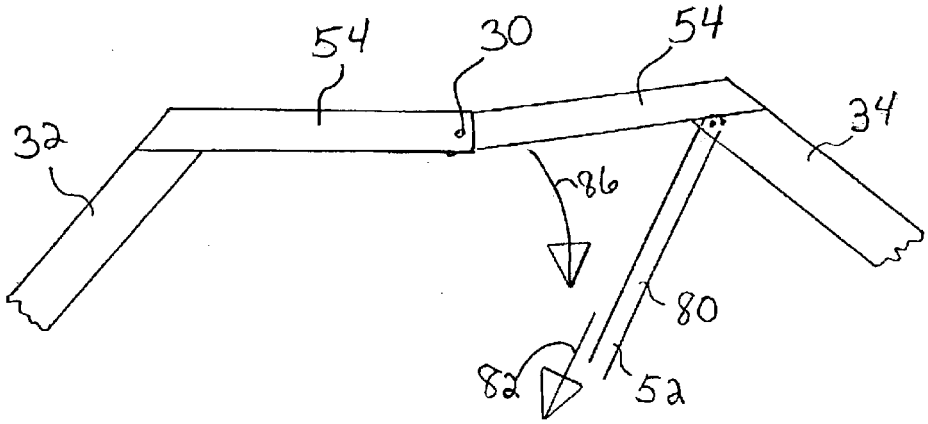
FIG. 10, in a partial front elevational view with sections taken out, illustrates some of the components of the linkage and hinge assembly shown in FIGS. 2, 4, 6, 8, and 9 when the latter acts as a movement facilitating means for facilitating the movement of the foldable seating structure from its deployed towards its folded configuration.

The tension of the first and second proximal-to-distal leg linking members 50 is transmitted respectively to the first and second proximal leg-to-opposed section linking members 52 as indicated by arrows 82 in FIGS. 9 and 10. The relationship between the pivot axis 30 and the crossing location 80 is such that the moment of force indicated by arrow 84 in FIG. 9 tends to create a self-locking action for maintaining the foldable frame 18 in its deployed configuration.

Conversely, when pivoting the foldable frame 18 towards its folded configuration is initiated, the pivoting axis 30 shifts to a position located above the level of the crossing location 80, hence inverting the moment of force now referred to by reference numeral 86 in FIG. 10 as opposed to the moment of force 84. The moment of force 86 tends to facilitate or help the movement of the foldable frame 18 towards its folded configuration shown in FIG. 7.

In other words, once the folding motion is initiated, the force generated by the biasing means 56 helps an intended user to fight against gravity for folding the foldable frame 18 towards the folded configuration. Accordingly, the biasing force created by the biasing means 56 is used both providing a self-locking mechanism for maintaining the foldable frame 18 in a deployed configuration and for assisting in folding the foldable frame 18 towards its folded configuration depending on the relationship between the first and second hinge members 54 and the first and second proximal leg-to-opposed section linking members 52. Typically, although by no means exclusively, the shift in the direction of the moment of force 86 occurs when the first and second frame section 20, 22 are lifted by about 10 degrees relative to the ground surface. It should be understood that other angular values could be used without departing from the scope of the present invention.

When in the deployed configuration, the foldable seating structure 10 may be used seating intended users in a side-by-side relationship relative to each other. When in the folded configuration, the seating structure 10 may easily be moved by rolling on its caster-type wheels 58 to another usage location or to a storage location where it may be respectively deployed or maintained in its folded configuration. When in the folded configuration, the position of the caster-type wheels 58 reduces the risks of tilting.

Optionally, the proposed seating structure may be provided with various accessories releasably attachable thereto such as a coat hanger, a magazine rack, arm rests or tables.

I claim:

1. A foldable seating structure for allowing a first and a second user to sit thereon, said seating structure comprising:

a foldable frame, said foldable frame defining a first frame section and a second frame section, said first and second frame sections respectively defining a first and a second frame axis, said first and second frame sections being coupled together by a section hinge, said section hinge allowing said first and second frame sections to pivot relative to one another in a section pivoting plane about a section pivoting axis between a frame deployed configuration and a frame folded configuration wherein in said frame deployed configuration said first and second frame axes are in a substantially horizontal position and in a substantially co-linear relationship relative to each other and wherein in said frame folded configuration said first and second frames axes are in a substantially vertical position and in a substantially parallel and adjacent relationship relative to each other;

a first and a second seat respectively mounted on said first and second frame sections so as to extend respectively in a substantially parallel relationship relative to respectively said first and second frame axis;

said first and second frame sections respectively including corresponding first and second seat attachment members, said first and second seat attachment members respectively defining a corresponding first and second section proximal end and a corresponding first and second section distal end;

said first and second frame sections being also respectively provided with a first and a second proximal leg pivotally attached respectively to said first and second seat attachment members respectively adjacent said first and second section proximal ends;

said first and second frame sections being also respectively provided with a first and a second distal leg pivotally attached respectively to said first and second seat attachment members respectively adjacent said first and second section distal ends;

a first and a second proximal-to-distal leg linking member respectively pivotally attached between said first and second proximal and distal legs for ensuring that said first and second proximal legs pivot solidarly respectively with said first and second distal legs;

a first and a second proximal leg-to-opposed section linking member respectively pivotally attached to said first and second proximal legs and to an opposite frame section for ensuring that the movement of said first and second proximal legs are transmitted respectively to said second and first frame sections;

said first and second proximal leg-to-opposed section linking members being attached respectively to said second and first frame sections respectively proximally to said second and first section proximal ends;

said section hinge including a first and a second hinge member, said first and second hinge members being respectively fixedly attached to said first and second frame members; said first and a second hinge members being also pivotally attached together for relative pivotal movement therebetween about a hinge pivot axis; said first and second hinge members being configured, positioned and sized so as to form respectively a substantially "V"-shaped configuration and a substantially inverted "V"-shaped configuration when said foldable frame is respectively in said deployed configuration and in said folded configuration;

said first and a second proximal leg-to-opposed section linking members crossing by each other about a crossing location, said pivot hinge being located respectively underneath and above the level of said crossing location when said foldable frame is respectively in said deployed configuration and in said folded configuration;

a first and a second leg biasing means respectively extending between said first and second frame sections and respectively said first and second distal legs for biasing said first and second distal legs respectively away from said first and second frame sections;

wherein said section hinge, said first and second proximal legs, said first and second distal legs, said first and second proximal-to-distal leg linking members and said first and second proximal leg-to-opposed section linking members are configured and sized so that when said frame is in said deployed configuration, the force exerted by said biasing means puts said first and second proximal-to-distal leg linking members under tension; the tension of said first and second proximal-to-distal leg linking members being transmitted respectively to said first and second proximal leg-to-opposed section linking members; and the relationship between said pivot axis and said crossing location is such that the moment of force created by said biasing means creating a self-locking action for maintaining said foldable frame in said deployed configuration; and when said foldable frame is initially pivoted towards its folded configuration shifting of said pivoting axis to a position located above the level of said crossing location inverses the moment of force created by said biasing means so as to facilitate the movement of said foldable frame towards its folded configuration;

whereby, the biasing force created by said biasing means is used both for providing a self-locking action for maintaining said foldable frame in a deployed configuration and for assisting in folding said foldable frame towards its folded configuration depending on the relationship between said first and second hinge members and said first and second proximal leg-to-opposed section linking members.

2. A seating structure as recited in claim 1 further comprising a pair of wheels rotatably mounted to said foldable frame adjacent said first and second frame distal ends.

3. A seating structure as recited in claim 2 wherein said wheels are positioned so as to stably support maid foldable frame thereon when said foldable frame is in said folded configuration.

4. A seating structure as recited in claim 1 wherein each of said first and second distal legs defines a distal leg attachment segment pivotally attached respectively to said first and second frame members and a distal leg supporting segment extending from said distal leg attachment segment for contacting the ground surface; said distal leg attachment segment defining an attachment segment sustentation polygon larger then that of said distal leg attachment segment.

* * * * *